US007631800B2

(12) United States Patent
Cai et al.

(10) Patent No.: US 7,631,800 B2
(45) Date of Patent: Dec. 15, 2009

(54) CLAMSHELL FOOD CONTAINER WITH SAUCE HOLDER AND CARTON BLANK THEREFOR

(75) Inventors: Liming Cai, West Chester, PA (US); Deanna Dixon Sievers, Coconut Grove, FL (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 11/987,429

(22) Filed: Nov. 30, 2007

(65) Prior Publication Data

US 2009/0140032 A1 Jun. 4, 2009

(51) Int. Cl.
*B65D 25/04* (2006.01)

(52) U.S. Cl. ..... 229/120.18; 229/114; 229/120.21; 229/904

(58) Field of Classification Search ..... 229/120.18, 229/120.13, 120.21, 904, 114; 206/561–565
See application file for complete search history.

(56) References Cited

U.S. PATENT DOCUMENTS

| | | | | |
|---|---|---|---|---|
| 2,924,372 | A | 2/1960 | Kirkeby | |
| 3,899,119 | A | 8/1975 | Roccaforte | |
| 4,572,423 | A | 2/1986 | Spencer | |
| 5,553,772 | A * | 9/1996 | Jensen | 229/114 |
| 5,707,004 | A * | 1/1998 | Cai | 229/114 |
| 5,890,648 | A * | 4/1999 | Cai | 229/904 |
| 6,527,123 | B1 | 3/2003 | Ausaf | |
| 6,568,586 | B1 | 5/2003 | VanEsley | |
| 6,851,603 | B1 * | 2/2005 | Carlson et al. | 229/906 |
| 6,892,932 | B2 * | 5/2005 | Correll | 229/120.18 |
| 7,007,837 | B2 * | 3/2006 | Correll | 229/120.18 |
| 7,293,695 | B2 * | 11/2007 | Stier | 229/904 |
| 2003/0026875 | A1 | 2/2003 | Aguilar | |

FOREIGN PATENT DOCUMENTS

| | | |
|---|---|---|
| GB | 2 240 323 | 7/1991 |

* cited by examiner

*Primary Examiner*—Gary E Elkins
(74) *Attorney, Agent, or Firm*—Dennison, Schultz & MacDonald

(57) ABSTRACT

A clamshell container and sauce holder for receiving a sauce container is constructed from a one-piece carton blank cut and scored to facilitate erection into a clamshell container with top and bottom portions hingedly connected along a common fold line. A bottom portion of the container includes an upper flat section extending inwardly from a bottom side wall, an integral support and a base member including a tuck flap for positioning the upper flat section. In addition, an opening is defined in the upper flat section for holding a sauce container.

10 Claims, 4 Drawing Sheets

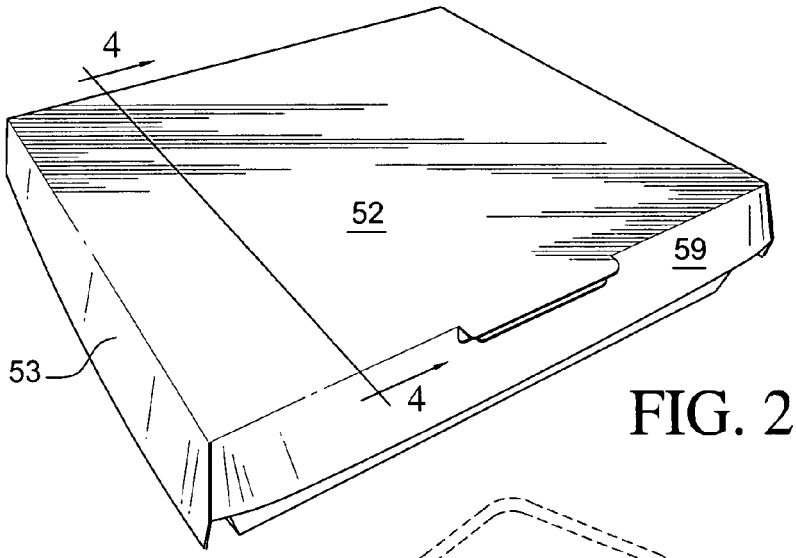
FIG. 2
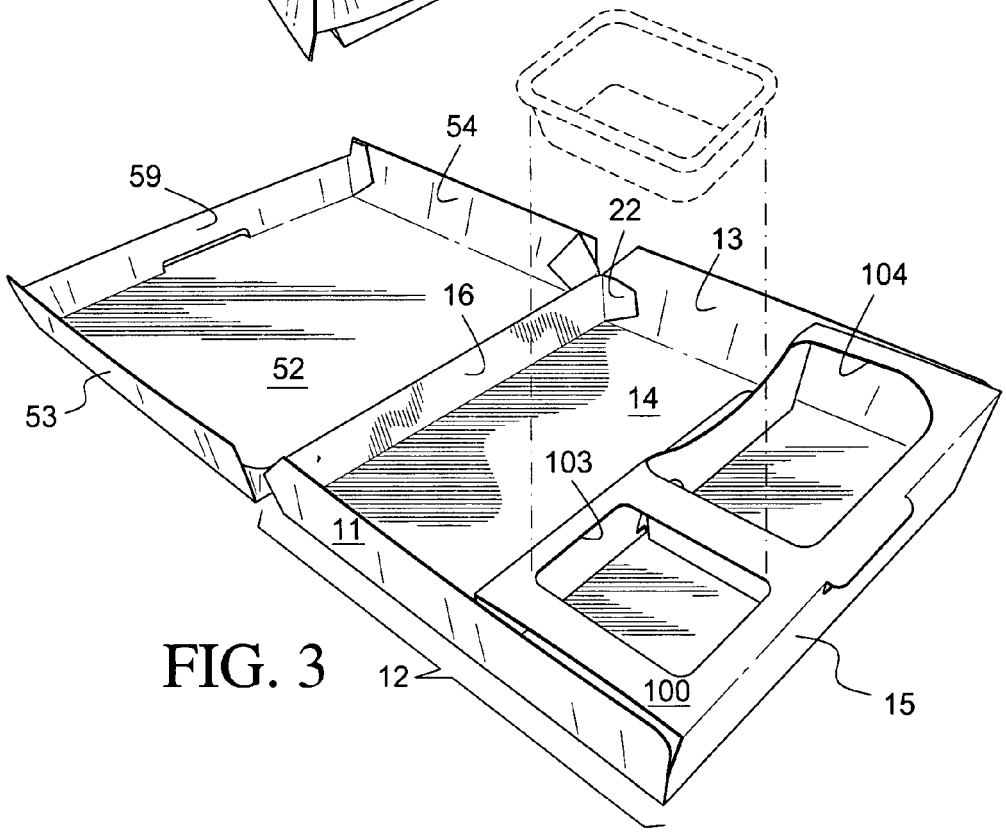
FIG. 3
FIG. 4
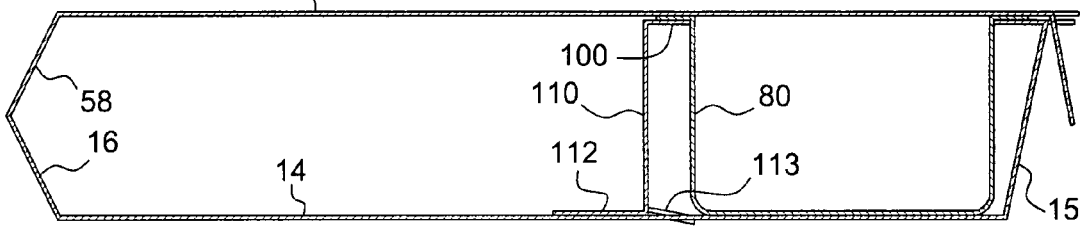

CLAMSHELL FOOD CONTAINER WITH SAUCE HOLDER AND CARTON BLANK THEREFOR

FIELD OF THE INVENTION

This invention relates to a clamshell food container and a one piece carton blank for forming a clamshell container, and more particularly to a clamshell food container with a dipping sauce holder and a carton blank for forming such containers.

BACKGROUND FOR THE INVENTION

Cartons and sheet material products for use in the fast food industry are well known. Such cartons or sheet material products typically include a tray or lower portion and a lid or top portion which is hingedly connected to the lower portion. The cartons are typically formed from a simple paperboard blank which is suitably pre-cut and pre-scored and which when folded and assembled forms a clamshell type of container. Such containers are widely used for hamburgers, cheeseburgers, fish sandwiches and the like. However, such containers do not generally provide for condiments and sauce for finger foods such as chicken nuggets, popcorn shrimp, french fries, onion rings, and the like that are frequently served in paper board trays. These trays have flat bottom walls and side walls that extend upwardly therefrom at an angle that define a top opening larger than the bottom wall. Further, many of the aforementioned foods are frequently eaten with condiments such as ketchup, cocktail sauce, barbecue sauce etc.

Since finger foods are frequently eaten with ones fingers, a person typically holds a food item in their fingers and dips it into a condiment. When eating in a sit down restaurant, the condiments are dispensed directly onto a plate or a tub of the condiment or served in a separate container that can be placed on a table next to the consumer. However, when consuming such products in an automobile or while walking, it becomes difficult to use condiments. One must either pour a large quantity of condiments directly onto the food product or use one hand to carry the tray and a second hand to carry a tub of condiment. A user must therefore juggle the condiment and tray in order to dip and eat the food.

Accordingly, the present invention is directed to a novel structure for a clamshell container that includes one or more compartments that can be used to hold one or more condiment separate from a food product. The invention also contemplates a one-piece carton blank that is adapted to be folded into a clamshell container for a food product and a dipping sauce holder.

BRIEF SUMMARY OF THE INVENTION

In essence, the present invention contemplates a clamshell food container with a dipping sauce holder. The container includes a one-piece flat sheet of carton material cut and scored to facilitate erection into a box-like structure. In a first embodiment of the invention, the clamshell food container includes a first common fold line, as well as a top and a bottom hingedly connected along the first common fold line to form a clamshell type structure. The top of the container includes a flat top portion, a plurality of top fold lines and a plurality of top side walls integrally connected to the flat top portion by the plurality of top fold lines. In addition, a plurality of connecting tabs connect the plurality of top side walls one to another to maintain the top in an open box-like structure. The bottom of the container includes a flat bottom portion having a tuck flap slit formed therein. The bottom of the container also includes a plurality of bottom fold lines and a plurality of bottom side walls integrally connected to the bottom portion by the plurality of bottom fold lines. In addition, a plurality of tabs connect the plurality of bottom side walls one to another to maintain the bottom in an erect position in the form of an open box-like structure.

An important feature of the invention resides in one of the bottom side walls including an upper flat section extending inwardly from one of the bottom side walls preferably a front bottom side wall. An integral vertical wall extends down from the upper flat section to the flat bottom portion for supporting the flat section generally parallel to the flat bottom portion. Further, an integral generally horizontal base member juxtaposed on the flat bottom portion extends inwardly from the bottom of the vertical wall i.e. toward the rear wall. A tuck flap is also formed in the vertical wall and folded down and into the tuck flap slit for positioning the vertical wall. In addition, the upper flat section includes a dipping sauce holder adapted to hold a sauce container within an area bounded by one of the bottom side walls, the vertical wall, the flat bottom portion and the flat section.

Another embodiment of the invention contemplates a one-piece carton blank of stiff resilient sheet material that is adapted to be folded into a clamshell type container for a food product and holder for a sauce container. The one-piece carton blank is made of a stiff resilient and foldable sheet material adapted to be folded into a clamshell type container for a food product and sauce holder. The one-piece carton blank includes a plurality of fold lines and a central lid forming portion having front, rear and side wall closure panels, each being foldably connected by one of the plurality of fold lines to the central lid. A central tray forming portion includes a tuck flap slit as well as a front, rear and side wall closure panels foldably connected to the central tray. The rear wall closure panel of the lid portion is hingedly connected to the rear wall closure panel of the tray by one of the plurality of fold lines to hingedly join the central lid forming portion and the tray portion to thereby provide a closeable structure. In addition, a plurality of end glue flaps, a first pair of which extend from the rear closure panel of the central lid and a second pair from the rear closure panel of the tray, a third pair of which extend from the front closure panel of the central lid and a fourth pair of which extend from the front closure panel of the tray are provided.

An upper tray section of the carton blank extends from a top portion of the front closure panel of the tray and includes a cut out sauce holder for receiving a sauce container. The upper tray section is adapted to fold along a fold line between the upper tray section and the top portion of the front closure panel of the tray. Therefore, when the container is assembled, the upper tray section extends inwardly into a forward portion of a clamshell container. A support for the upper tray section extends from the upper tray section and includes a foldable base member separated from one another and from the front closure panel of the tray portion by fold lines that are parallel to one another. In this embodiment of the invention, the support includes a tuck flap and wherein the support and the tuck flap are positioned and dimensioned so that the tuck flap fits into the tuck flap slit in the central tray and the support is adapted to position the upper tray parallel with the central tray. The foldable base member is dimensioned and constructed so that when the carton blank is assembled the base member will be juxtaposed on the central tray and the upper portion of the front closure panel of the tray portion includes an elongated cut to thereby form a forwardly extending first closure member extending outwardly from the upper tray when assembled into a clamshell container and the front closure panel of the central lid includes a longitudinal cut forming a second forwardly extending closure member in the central lid for engaging said first closure member to maintain the container in a closed position. In a preferred embodiment of the invention, the carton blank is constructed and dimensioned so that the central lid is positioned over the upper section and in close proximity i.e., in contact with the upper section in order to serve as a cover for a sauce container when a sauce container is placed in the sauce holder.

BRIEF DESCRIPTION OF THE DRAWINGS

FIG. 2 is a perspective view of a clamshell container made from a carton blank of FIG. 1 and shown in a closed position;

FIG. 3 is a perspective view of the clamshell container shown in FIG. 2 but with the clamshell container in an open position;

FIG. 4 is a side elevational view of the clamshell container shown in FIGS. 2 and 3;

DESCRIPTION OF THE PREFERRED EMBODIMENTS OF THE INVENTION

Figure 1:
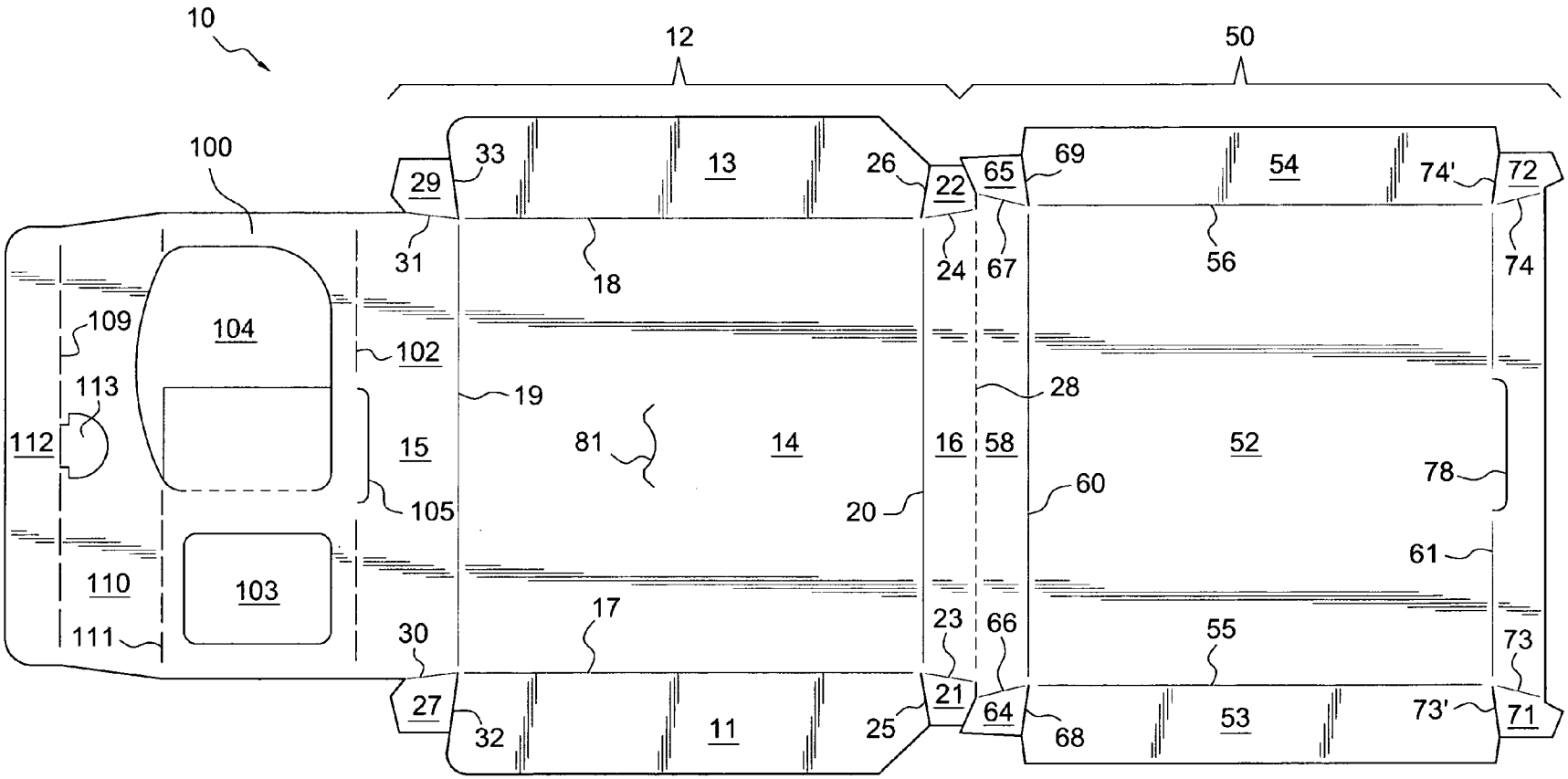
FIG. 1 is a plan view of a carton blank in accordance with one embodiment of the invention.
Figure 5:
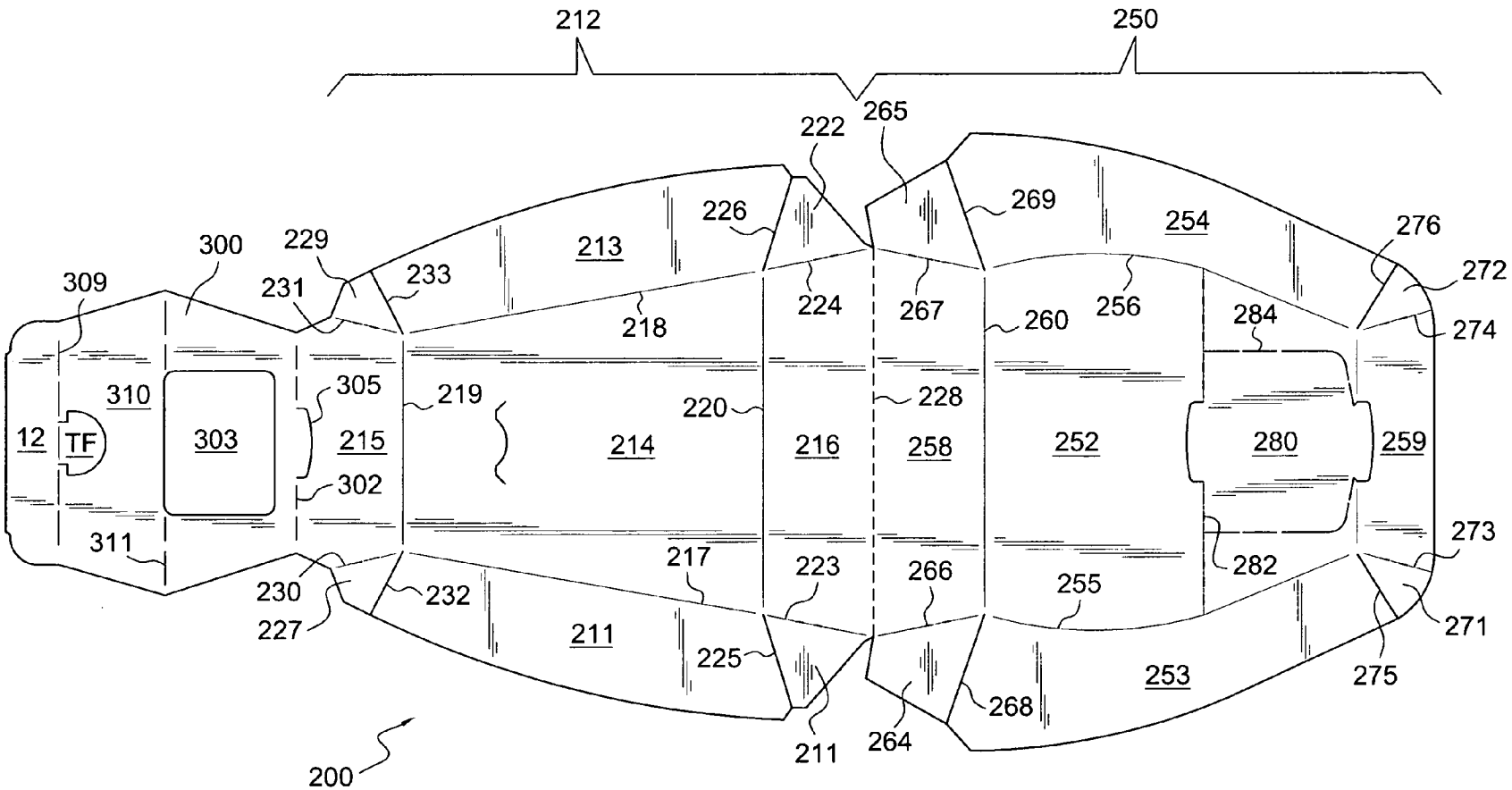
FIG. 5 is a plan view of a carton blank in accordance with another embodiment of the invention.
Figure 6:
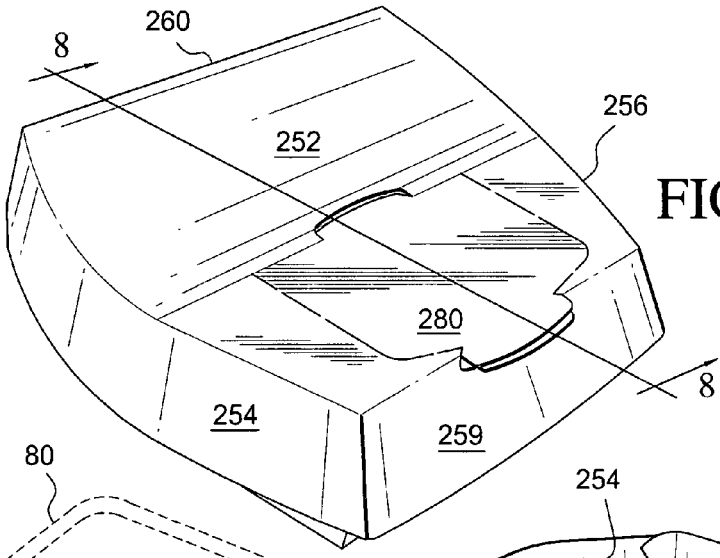
FIG. 6 is a perspective view of a clamshell container made from the carton blank of FIG. 5 wherein the clamshell container is in a closed position.

A clamshell food container with a sauce holder and carton blank for forming such container in accordance with one embodiment of the invention will now be described with reference to FIGS. 1-4. As shown more clearly in FIG. 1, a one-piece carton blank 10 is formed as a single planar item from a single sheet of foldable material. The preferred materials are paperboard of the type conventionally used in food containers. Such material should be capable of resisting moisture at least to a limited degree, be easily formed into a carton, be relatively inexpensive and in effect incorporate all of the desired attributes of a fast food container. As illustrated the carton blank 10 is operable to be erected and retained by adhesive into an easy open, easy close clamshell type of container as illustrated in FIGS. 2-4.

As illustrated in FIGS. 1-4, the carton blank 10 includes a base or bottom 12 and a top 50. The base or bottom 12 includes a generally flat polygonal tray or bottom portion 14 which may be in the shape of a square or rectangle. The base or bottom 12 also includes two opposite bottom side panels or walls 11 and 13, a front bottom panel or wall 15 and a bottom rear panel or wall 16 which are adjacent to and integrally connected to the bottom portion 14 by fold lines 17, 18, 19 and 20 of the bottom portion 14 also includes a tab flap slit 81 in a central portion thereof.

The bottom rear panel or wall 16 also includes two generally trapezoidal glue flaps 21 and 22 at opposite ends of the bottom rear wall 16 and separated therefrom by fold lines 23 and 24. The glue tabs 21 and 22 are also separated from the bottom side panels or walls 11 and 13 by cuts 25 and 26. The bottom rear panel or wall 16 is also integrally connected to the top 50 by a fold line 28.

A second pair of polygonal shaped bottom glue tabs 27 and 29 are integrally connected to the bottom front panel or wall 15 along the fold lines 30 and 31. These glue tabs 27 and 29 are separated from the bottom side panels or walls 11 and 13 by cuts 32, 33.

Figure 7:
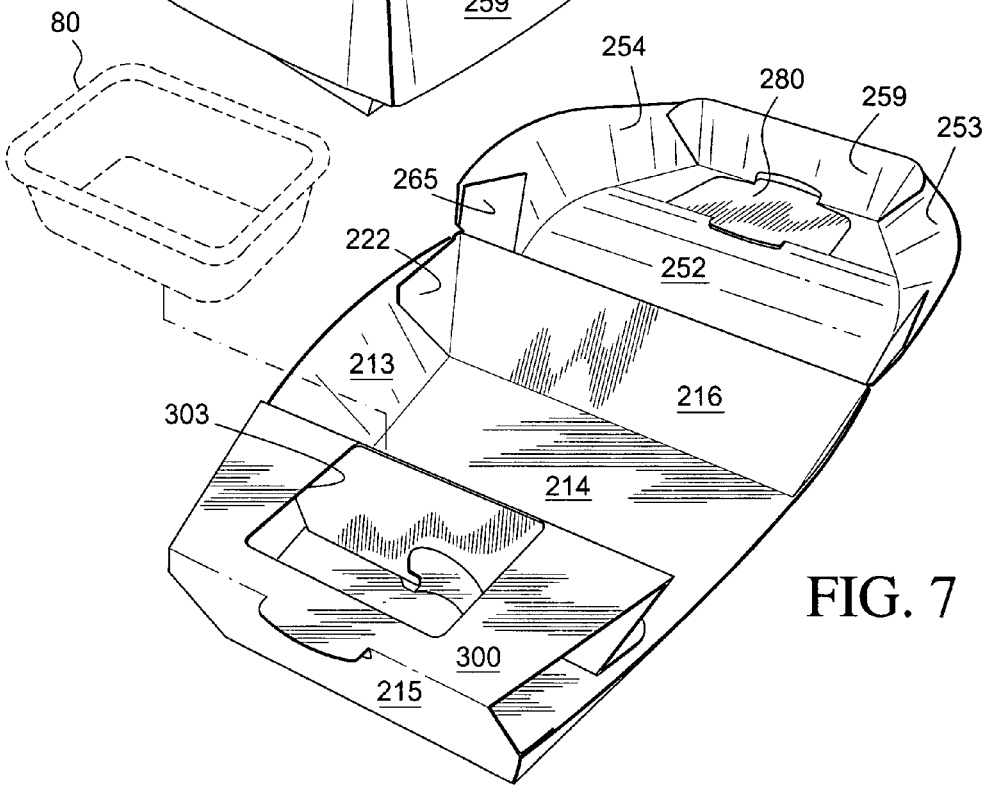
FIG. 7 is a perspective view of the clamshell container shown in FIG. 6 but wherein the container is in an open position.
Figure 8:
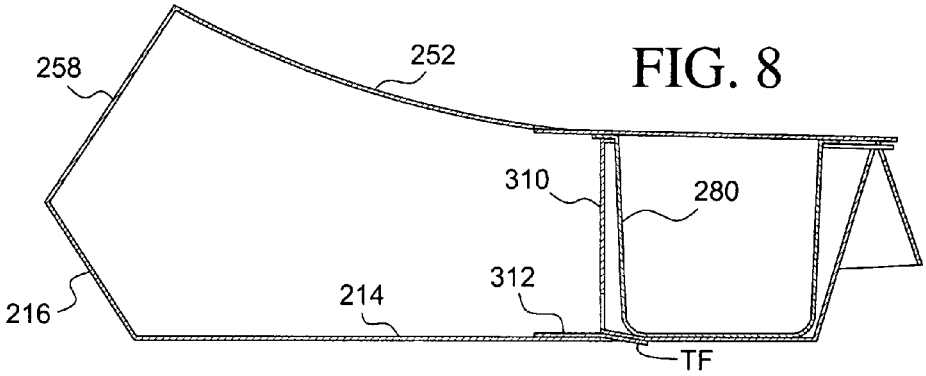
FIG. 8 is a side elevational view of the clamshell container shown in FIGS. 6 and 7.

The front bottom panel or wall 15 includes an extension or upper tray section 100 which is connected to the bottom panel or wall 15 along a fold line 102. A longitudinal cut 105 along the fold line 102 forms a tongue and slot part of an EZ latch mechanism. The upper tray section defines an opening or sauce holder 103 for receiving a sauce container 80 (see FIG. 7). A second opening 104 is also defined by the tray section 100 and can be used to contain a second sauce container or the like. A support 110 extends outwardly from the section 100 and is separated therefrom by a fold line 111. The support 110 is also connected to a base member 112 by a fold line 109. The support 110 also includes a cut forming a tab flap 113.

The top 50 includes a top flat polygonal portion 52 which preferably defines a generally square or rectangular shape which is of about the same size and shape as the bottom portion 14. The top 50 also includes a pair of integral top side panels or walls 53 and 54 on opposite sides of the top flat polygonal portion 52 and separated therefrom by fold lines 55 and 56. The top 50 also includes a top rear panel 58 and top front panel 59 which are integrally joined to the top flat polygonal portion 52 along fold lines 60 and 61. A cut 78 along fold line 61, but extending into the panel 59 forms a tongue and slot as part of an EZ latch mechanism.

The top rear panel 58 includes integrally connected glue tabs 64 and 65 which are separated from the top rear panel 58 by fold lines 66 and 67 and further separated from the top side panels 53 and 54 by cuts 68 and 69. The top rear panel 58 is also integrally connected to the bottom rear panel 16 along the fold line 28. The top front panel 59 also includes integrally connected glue tabs 71 and 72 which are separated from the top front panel 59 by fold lines 73 and 74 and from the side panels 53 and 54 by cuts 73' and 74'.

A sauce container 80 is shown in dotted lines in FIG. 3 and in solid lines in FIG. 4 as positioned and held in place by the edges of the opening 103 in the upper tray section 100.

The erected carton as shown in FIGS. 2-4 is formed into a clamshell type container. For example, the base or bottom 12 is formed and maintained in an open box-like structure by gluing tabs 21 (see FIG. 1) and 22 and 27 and 29 to the sidewalls 11 and 13. In a similar manner the top 50 is formed into an open box-like structure by gluing the glue tabs 64 and 65 (FIG. 1) and 71 and 72 to the sidewalls 53 and 54.

A second embodiment of the invention is illustrated in FIGS. 5-8. As shown therein, a carton blank 200 (shown in FIG. 5) is formed of a single sheet of foldable material of the same type as used in a first embodiment of the invention. The carton blank 210 includes a base or bottom 212 and top 250. The base or bottom 212 includes a generally flat trapezoidal shaped tray or bottom portion 214 having its smaller side toward the front of the carton or clamshell container. The base or bottom 212 also includes two opposite side panels or walls 211 and 213, a front bottom panel or wall 215 and a bottom rear panel or wall 216 which are adjacent to and integrally connected to the bottom portion 214 by fold lines 217, 218, 219 and 220.

The bottom rear panel or wall 216 also includes two glue flaps 221 and 222 at opposite ends of the bottom rear wall 216 and separated therefrom by fold lines 223 and 224. The glue taps 221 and 222 are also separated from the bottom side panels or walls 211 and 213 by cuts 225 and 226. The bottom rear panel or wall 216 is also integrally connected to the top 250 by a fold line 228.

A second pair of polygonal shaped bottom glue tabs 227 and 229 are integrally connected to the bottom front panel or wall 215 along the fold lines 230 and 231. These glue tabs 227 and 229 are separated from the bottom side panels or walls 211 and 213 by cuts 232 and 233.

The front panel or wall 215 includes an extension or upper tray section 300 which is connected to the bottom panel or wall 215 along a fold line 302. A longitudinal cut 305 along the fold line 302 forms a part of an EZ latch mechanism. The upper tray section defines an opening or sauce holder 303 for receiving a sauce container (shown in FIG. 7). A support 310 extends outwardly from the section 300 and is separated therefrom by a fold line 311. The support 310 is also connected to a base member 312 by a fold line 109. The support 310 also includes a cut forming a tab flap TF.

The top 250 includes a top flat portion 252 which preferably defines a generally trapezoidal shape which is of about the same size and shape as the bottom portion 214. The top 250 also includes a pair of integral top side panels or walls 253 and 254 on opposite sides of the top flat portion 252 and separated therefrom by arcuate fold lines 255 and 256. The top 250 also includes a top rear panel 258 and top front panel 259 which are integrally joined to the top flat portion 252 along fold lines 260 and 261.

The top rear panel 258 includes integrally connected glue tabs 264 and 265 which are separated from the top rear panel 258 by fold lines 266 and 267 and further separated from the top side panels 253 and 254 by cuts 268 and 269. The top rear panel 258 is also integrally connected to the bottom rear panel 216 along the fold line 228 while a fold line 260 separates the panel 258 from the top flat portion 252. The top front panel 259 also includes integrally connected glue tabs 271 and 272 which are separated from the top front panels 259 by fold lines 273 and 274 and from the side panels 253 and 254 by cuts 275 and 276. The erected carton as shown in FIGS. 5-8 is formed into a clamshell container. For example, the base or bottom 212 is formed and maintained into an open box-like structure by gluing tabs 221, 222, 227 and 229 to the side walls 211 and 213. In a similar manner the top 250 is formed in an open box-like structure by gluing the glue tabs 264 and 265 (FIG. 1) and 271 and 272 to the side walls 253 and 254.

The top flat portion 252 also includes a separate flap cover 280 formed by a fold line 282 and cut 284 that extends from the fold line 282 around three sides of the cover 280 and back to the fold line 282. This separate flap cover is constructed and dimensioned to fit over a sauce container and to give access to the sauce container when the clamshell container is in a closed position.

While the invention has been defined in connection with its preferred embodiments, it should be recognized that changes and modifications can be made therein without departing from the scope of the appended claims.

What is claimed is:

1. A clamshell food container with a dipping sauce holder, said container comprising:

a one-piece flat sheet of carton material cut and scored to facilitate erection into a box-like structure;

said clamshell food container including a first common fold line, and a top and a bottom hingedly connected along said common fold line to form a clamshell type structure;

said top including a flat top portion, a plurality of top fold lines and a plurality of top side walls integrally connected to said flat top portion by said plurality of top fold lines and a plurality of connecting tabs connecting said plurality of top side walls one to another to maintain said top in an open box-like structure;

said bottom including a flat bottom portion having a tuck flap slit formed therein, a plurality of bottom fold lines and a plurality of bottom side walls integrally connected to said bottom portion by said plurality of bottom fold lines, a plurality of tabs connecting said plurality of bottom side walls one to another to maintain said bottom in an erect position in the form of an open box-like structure;

one of said bottom side walls including an upper flat section extending inwardly from one of said bottom side walls, and an integral vertical wall extending down to said flat bottom portion for supporting said flat section generally parallel to said flat bottom portion, and an integral generally horizontal base member juxtaposed on said flat bottom portion, and a tuck flap formed in said vertical wall and folded down and into said tuck flap slit for folding and positioning said vertical wall;

said upper flat section including a dipping sauce holder adapted to hold a sauce container within an area bounded by one of said bottom side walls, said vertical wall, said flat bottom portion and said flat section;

wherein said top and bottom of said container are hingedly connected at the back of said carton and said one of said bottom side walls is at the front of said container opposite from the back of said container; and wherein said flat top portion forms a cover for the sauce container by contacting a top of a sauce container.

2. A clamshell container according to claim 1 which includes an E-Z lock mechanism.

3. A clamshell container according to claim 2 in which the E-Z lock mechanism includes a male member extending outwardly from said flat section and in which one of said top side walls includes a member receiving slit.

4. A clamshell container according to claim 1 in which a separate part of said flat cover portion of a sauce holder is operable separately to provide access to a sauce holder without separating the top and bottom of the container.

5. A clamshell container according to claim 1 in which said top includes a forwardly slanted surface portion.

6. A clamshell container according to claim 1 in which said top includes a pair of curved score lines which converge toward the front of the container.

7. A clamshell container according to claim 1 in which one of said top side walls includes a cut out along a fold line in an upper portion thereof and in which said upper flat section includes a forwardly extending male protrusion for fitting into said cut out to form an E-Z lock mechanism.

8. A one-piece carton blank of stiff resilient and foldable sheet material adapted to be folded into a clamshell type container for a food product and sauce holder, said blank including a plurality of fold lines and a central lid-forming portion having front, rear and side walls closure panels each being foldably connected by one of said plurality of fold lines to said central lid, a central tray-forming portion having a tuck flap slit and front, rear and side wall closure panels foldably connected to said central tray, and said rear wall closure panel of said lid portion hingedly connected to said rear wall closure panel of said tray by one of said plurality of fold lines to join said central lidforming portion and said tray portion to thereby provide a closeable structure, a plurality of end glue flaps, a first pair of which extend from said rear closure panel of said central lid and a second pair from said rear closure panel of said tray, a third pair of which extend from said front closure panel of said central lid and a fourth pair of which extend from said front closure panel of said tray;

an upper tray section including a cut out sauce holder for receiving a sauce container, a support for said upper tray section and a foldable base member for said base extending from said front closure panel of said tray and separated from said front closure panel of said tray portion and from one another by one of said fold lines that are parallel to one another; and said support including a tuck flap, and wherein said support and said tuck flap are positioned and dimensioned so that the tuck flap fits into said tuck flap slit in said central tray and said support supports and positions said upper tray parallel with said central tray and with said foldable base member juxtaposed on said central tray and wherein said upper portion of said first closure panel of said tray portion including an elongated cut to thereby form a forwarding extending first closure member extending outwardly from said upper tray when assembled into a clamshell container, and said front closure panel of said central lid including a longitudinal cut from a second forwardly extending closure member in said central lid for engaging said first closure member to maintain said container in a closed portion.

9. A one-piece carton blank according to claim 8 in which said side closure panels of said central lid and said central tray define curved edges that converge from said rear panel closure panels and said front panel closure members.

10. A one-piece closure blank according to claim 9 in which said fold lines forming said side closure panels are curved in a similar manner to the curved edges of said side closure panels.

* * * * *